US006406387B1

(12) United States Patent
Ryan

(10) Patent No.: US 6,406,387 B1
(45) Date of Patent: Jun. 18, 2002

(54) BASEBALL PRACTICE BAT

(76) Inventor: Richard L. Ryan, 1639 Alvarado Ct, Livermore, CA (US)

( * ) Notice: Subject to any disclaimer, the term of this patent is extended or adjusted under 35 U.S.C. 154(b) by 0 days.

(21) Appl. No.: 09/735,725

(22) Filed: Dec. 12, 2000

(51) Int. Cl.[7] ..... A63B 69/00
(52) U.S. Cl. ..... 473/457; 473/422; 473/549
(58) Field of Search ..... 473/422, 457, 473/468, 549–552, FOR 168, FOR 169, FOR 170; 463/47.2, 47.4

(56) References Cited

U.S. PATENT DOCUMENTS 3,030,837 A * 4/1962 Chartier ..... 72/457
3,136,546 A * 6/1964 Connolly ..... 473/457
4,214,751 A * 7/1980 Simpson ..... 473/457
5,011,145 A * 4/1991 Bartkowicz ..... 473/457
5,014,984 A * 5/1991 Brockhoff ..... 473/457
5,360,209 A * 11/1994 Mollica ..... 473/457
5,451,047 A * 9/1995 Liu ..... 473/457
5,577,722 A * 11/1996 Glassberg ..... 473/457
5,577,966 A * 11/1996 Duran ..... 473/457
5,839,983 A * 11/1998 Kramer ..... 473/457
5,938,532 A * 8/1999 Wall ..... 463/47.2
D444,193 S * 6/2001 Dodson ..... D21/725

FOREIGN PATENT DOCUMENTS

JP 10043340 * 2/1998 ..... 473/FOR 169

* cited by examiner

*Primary Examiner*—Paul T. Sewell
*Assistant Examiner*—Mitra Aryanpour

(57) ABSTRACT

Baseball Practice Bat with a main bat barrel, a slidable handle portion, a non slidable handle portion, a rigid centrally located shaft running through the main bat barrel, the slidable handle portion and the non sliding handle portion, a non pinch flange located on the bottom of the slidable handle, the flange having a downwardly facing post, the smaller flange on the non moving handle having a rubber washer attached to its top surface, the washer having a cut out area where said downwardly facing post can penetrate and make contact with the metal portion of said non moving handle, and finger locator portions that are molded into the side of the sliding handle and non sliding handle that helps the user align his or her knuckles with respect to both handles.

1 Claim, 3 Drawing Sheets

BASEBALL PRACTICE BAT

BACKGROUND OF THE INVENTION

This invention relates generally to the field of baseball equipment, and more particularly to baseball Practice Bat.

The game of baseball has been played in the united states for more than one hundred years. The game is played by opposing teams and consists primarily of a pitcher of one team throwing a ball to a batter of the other team who attempts to hit the ball with the bat and to then run to each of four bases successfully with out being tagged out. The bat tends to be round in cross section rather narrow in diameter, thereby making it difficult to hit a ball which tends to be only slightly larger in diameter than the bat barrel. Bats are generally constructed of wood or aluminum. There tend to be no moving parts on a baseball bat. Base ball players tend to spend many hours practicing their hitting technique so that when they play the game, they can hit the ball with maximum efficiency.

Hitting coaches know that the most efficient way to swing a bat for optimal performance is to have the leading arm do most of the work until the ball makes contact with the barrel of the bat. After that, both hands and arms are used equally. It is difficult, with a standard bat, for the batter or the coach to verify that the batter is actually using his or her leading arm properly. Additionally, coaches train their players to hold the bat in such a way that the batters knuckles of one hand are aligned with the knuckles of the other hand. This ideal alignment is also difficult to verify during the swinging process.

SUMMARY OF THE INVENTION

The primary object of the invention is to provide a baseball practice bat that helps the user perfect his or her swing for optimal hitting results.

It is a further object of the present invention to provide a practice bat that helps the batter learn how to use his or her leading arm in the first half of the swing.

It is a further object of the present invention to provide a practice bat that helps the batter learn how to keep his or her knuckles aligned on the bat during the swing.

Other objects and advantages of the present invention will become apparent from the following descriptions, taken in connection with the accompanying drawings, wherein, by way of illustration and example, an embodiment of the present invention is disclosed.

Baseball Practice Bat comprising: a main bat barrel, a slidable handle portion, a non moving aluminum handle portion, a rigid centrally located shaft running through said main bat barrel, said slidable handle portion and said non moving handle portion, a non pinch flange located on the bottom of said slidable handle, said flange having a downwardly facing post, said flange on said non moving handle having a rubber washer attached, said washer having a cut out area where said downwardly facing post can penetrate and make contact with the metal portion of said non moving handle, and molded finger positioning grips affixed to said sliding handle portion and said non moving handle portion that helps the user align his or her knuckles on both hands.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
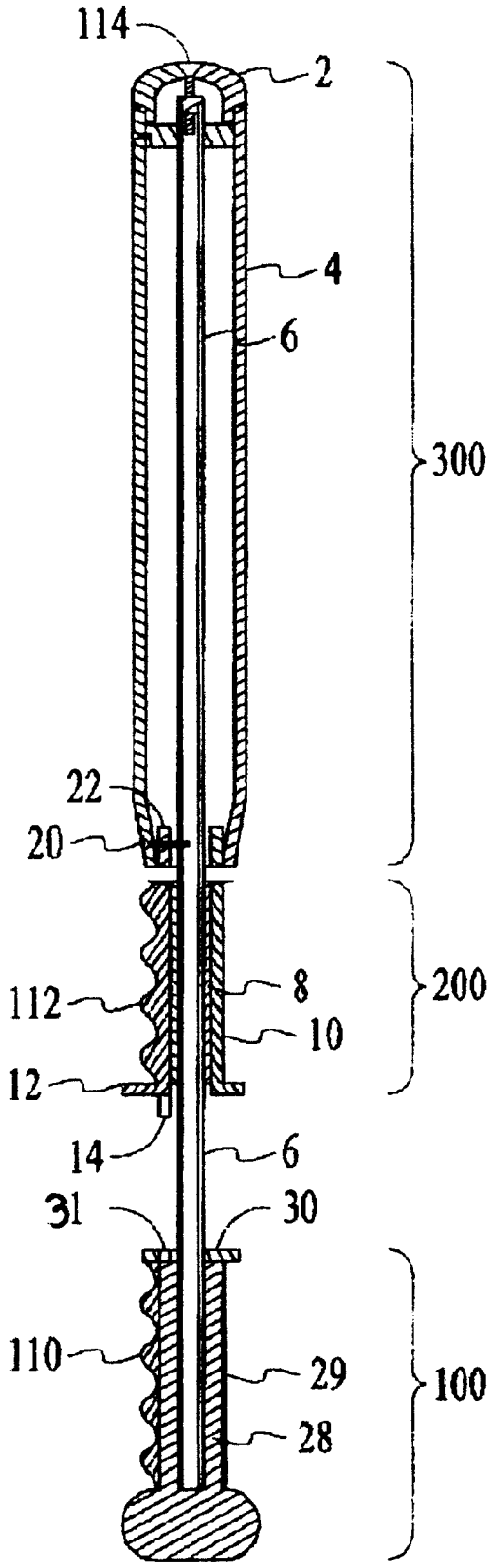
FIG. 1 is is a cross section view of the baseball practice bat of the present invention.
Figure 2:
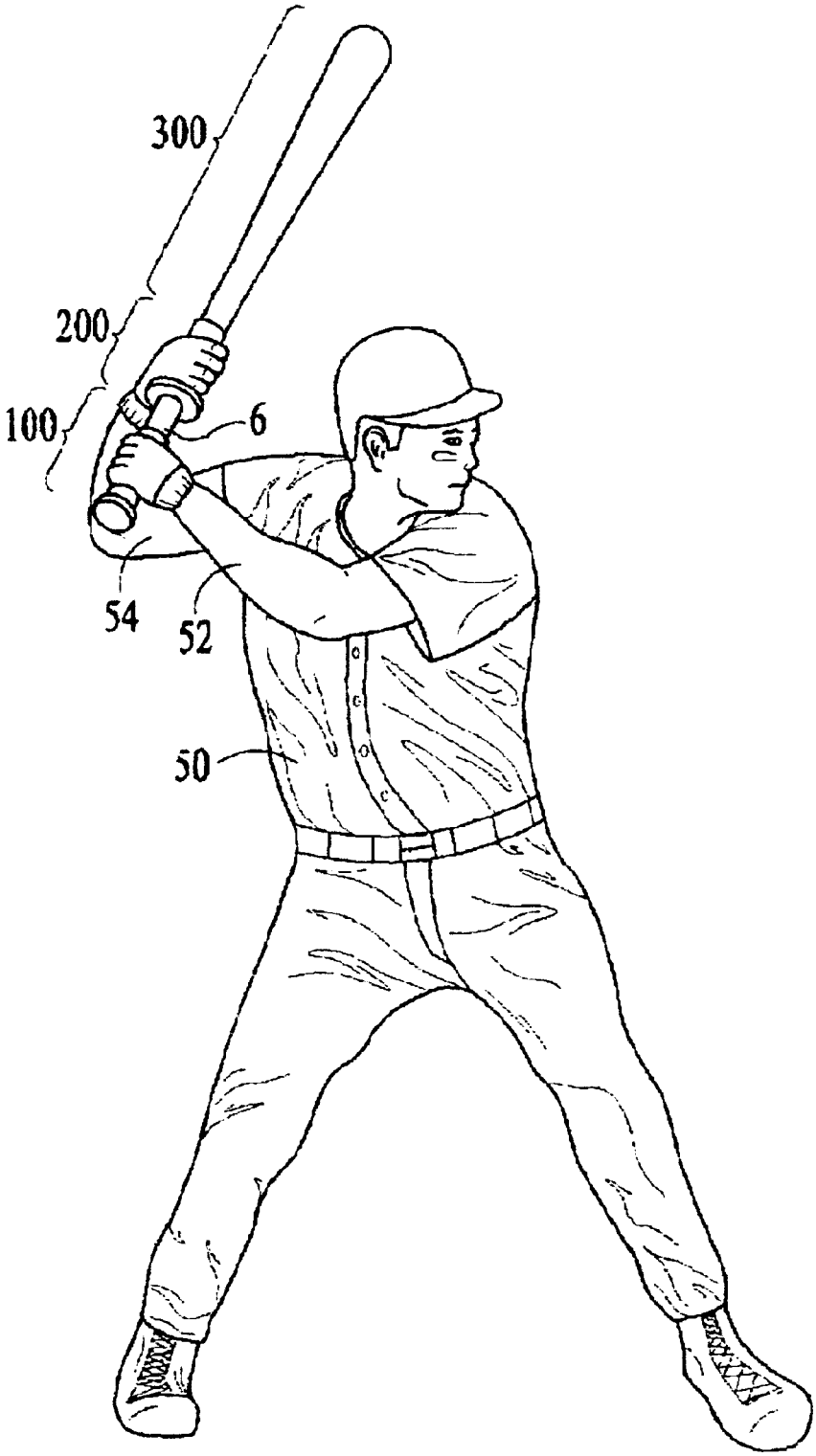
FIG. 2 is a perspective view of a person starting the swing using the bat of the present invention.
Figure 3:
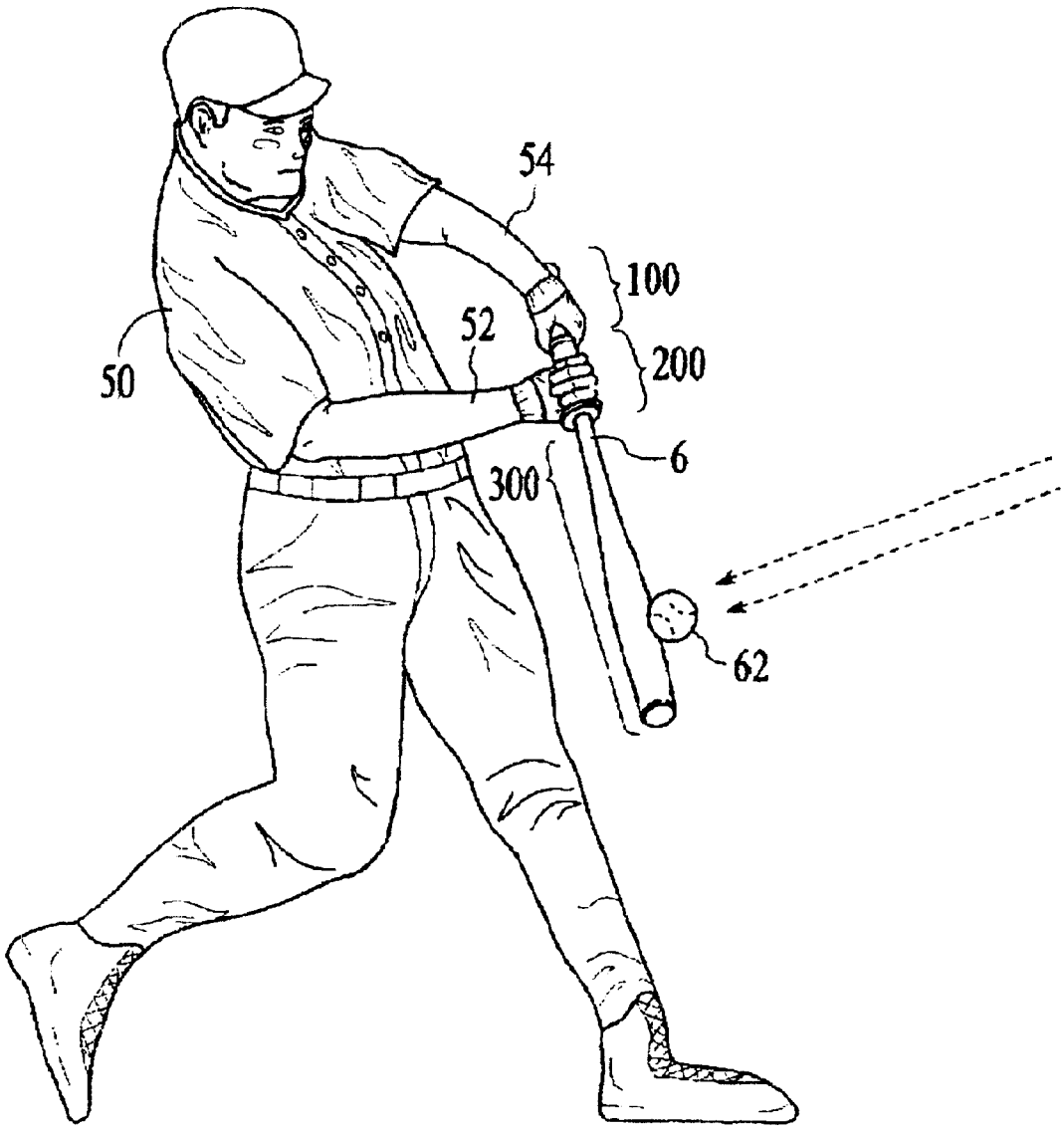
FIG. 3 is a perspective view of a person half way through the swing using the bat of the present invention.

Referring now to FIG. 1 we see a side section view of the baseball practice bat of the present invention. The bat is comprised of four main elements, the main bat barrel 300, the slidable handle 200 and the non slidable handle 100 all connected by a centrally located rigid shaft 6. Shaft 6 may be made from a tubular material such as stainless steel or may be made of solid material such as fiberglass or aluminum. Shaft 6 is centered and secured to barrel 4 by collar 22 which is held fixedly in place by set screw H 20. Rigid shaft 6 is also fastened to the top cover 2 of bat barrel 300 by screw 114 as it passes through bushing 116. Shaft 6 is fixedly secured to non movable handle 100 by adhesive or other known means. -Slidable handle 200 has a brass inner tube 8 that slidably fits around shaft 6. Brass tube 8 can also be constructed of rigid slidable plastic such as nylon. A rubber or rubberlike grip 10 surrounds brass tube 8 and terminates at one end in flange 12. A metal post 14 is secured to flange 12, protruding out approximately one quarter of an inch in a perpendicular fashion with relation to flange 12. Non slidable handle 100 is made of aluminum 28 and coated with a thin rubber or rubberlike material 29 and terminates at one end in flange 30. A rubber washer 16 is fixedly attached to flange 30 and has a cut out portion 31 allowing post 14 to penetrate washer 16 and strike aluminum handle 28 when slidable handle 200 is slid down. Molded in finger grip locators 112 found in the slidable handle and the non movable handle 110 allow the user to check alignment of the slideable handle 200 with the non slidable handle 100. This feature is useful because the user can position his or her hands on handles 200 and 100, align his or her knuckles on both hands 50 that the knuckles of both hands form a straight line. The practice bat of the present invention is used in the following way as shown in FIG. 2 and FIG. 3. The user 50 grips the bat handles 100, 200 so that slidable handle 200 is slid up close to bat barrel 300. Leading arm and hand 52 is held in the normal fashion. One key to optimal hitting is to let the leading hand and arm 52 do most of the work until pitched ball 62 strikes bat barrel 300, after which point both the leading arm 52 and the trailing arm 54 share the work equally. If the batter is using his leading arm 52 correctly the sliding handle 200 will slide down and meet non sliding handle 100 at the same moment that ball 62 strikes bat barrel 300. Additionally, if the batters hands have remained in the correct orientation, knuckles of each hand lined up, the post 14 will strike the metal portion of non moving handle 100 thereby making a loud clinking sound as the ball 62 hits the bat 300. If the knuckles have moved out of alignment post 14 will hit rubber washer 16 thereby making a soft thud.

In the above described and illustrated way, a batter can practice the correct method of hitting by verifying that his of her leading arm is doing most of the work prior to the ball hitting the bat and to verify that his or her hands remain correctly aligned.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A practice bat comprising:

a main bat barrel;

a slidable handle portion;

a non slidable handle portion;

a rigid centrally located shaft running through said main bat barrel, said slidable handle portion and said non sliding handle portion;

a flange located on the bottom of said slidable handle, said flange having a downwardly facing post;

a second flange located on the top of said non sliding handle;

said second flange having a rubber washer attached to its top surface, said rubber washer having a cut out area wherein said downwardly facing post can penetrate and make contact with the cut out area of said non sliding handle; and finger grip locators molded into the side of said sliding handle and said non sliding handle that help the user align his or her knuckles on both said handles.

* * * * *